United States Patent [19]

Cunliffe et al.

[11] Patent Number: 4,862,035

[45] Date of Patent: Aug. 29, 1989

[54] FLUORESCENT LAMP UNIT HAVING PLURAL SEPARATE TUBES AND PARTICULAR ARRANGEMENT OF CIRCUIT ELEMENTS

[75] Inventors: John Cunliffe, Manchester, N.H.; Brian J. Grabham, Bingley, England

[73] Assignee: GTE Sylvania Limited, Shipley, United Kingdom

[21] Appl. No.: 315,211

[22] Filed: Feb. 23, 1989

Related U.S. Application Data

[63] Continuation of Ser. No. 104,138, Oct. 5, 1987, abandoned.

[51] Int. Cl.[4] ..... H01J 61/72; H01J 61/30

[52] U.S. Cl. ..... 315/58; 315/68; 315/71; 315/73; 315/96; 315/97; 315/100; 315/122; 315/189; 313/493

[58] Field of Search ..... 315/57, 58, 64, 68, 315/71, 73, 94–97, 100–107, 121–122, 189; 313/493

[56] References Cited

U.S. PATENT DOCUMENTS

| | | | |
|---|---|---|---|
| 4,208,618 | 6/1980 | Heine | 313/493 |
| 4,383,200 | 5/1983 | Van Zon et al. | 313/493 |
| 4,513,225 | 4/1985 | Lemners et al. | 315/189 |

FOREIGN PATENT DOCUMENTS

| | | | |
|---|---|---|---|
| 181398 | 5/1986 | European Pat. Off. | 313/493 |
| 2119472 | 10/1972 | Fed. Rep. of Germany | 315/57 |
| 61-78043 | 4/1986 | Japan | 313/493 |
| 61-78046 | 4/1986 | Japan | 313/493 |
| 2157883 | 10/1985 | United Kingdom | 315/57 |

*Primary Examiner*—James J. Groody
*Assistant Examiner*—Mark R. Powell
*Attorney, Agent, or Firm*—Carlo S. Bessone

[57] ABSTRACT

A fluorescent lamp unit comprising a self-contained assembly intended for use in replacement for a conventional incandescent filament lamp comprises two U-shaped fluorescent tubes (54, 55), each provided with filaments (56, 57) at respective ends of the arc discharge path. Lead-in wires (60, 68, 69, 76) are arranged to connect the separate arc discharge paths of the two fluorescent tubes in series, and remaining lead-in wires (61, 70, 67, 73) of the fluorescent tubes are connected to components of a starter circuit housed within the mounting (20, 22) of the lamp unit. The starter circuit preferably comprises a separate glow bottle switch (62, 71) for each fluorescent tube, and a single capacitor (65).

5 Claims, 3 Drawing Sheets

FLUORESCENT LAMP UNIT HAVING PLURAL SEPARATE TUBES AND PARTICULAR ARRANGEMENT OF CIRCUIT ELEMENTS

This application is a continuation of application Ser. No. 104,138, filed Oct. 5, 1987 now abandoned.

This invention concerns fluorescent lamps, and more especially so-called compact fluorescent lamps that are intended to be used as direct replacements for the conventional incandescent lamp.

In a known construction of such a compact fluorescent lamp, an assembly which replaces the incandescent lamp is constructed as two interconnected components, namely a base fitting that has an electrical connection with the same configuration as the base of a conventional incandescent lamp, and a fluorescent lamp unit that is releasably connected to the base fitting. The base fitting contains the ballast required to be included in the electrical circuit of the fluorescent lamp, whereas the detachable fluorescent lamp unit comprises a fluorescent tube assembly defining a folded arc discharge path extending between filaments located at respective ends of said path, a mounting supporting said fluorescent tube assembly and providing releasable mechanical and electrical connections for engagement with a base fitting, and starter means housed within said mounting and electrically connected with said lamp filaments.

In fluorescent lamp units of the aforementioned type, various arrangements have been proposed for the incorporation of the fluorescent tube and the associated starter circuit in a compact unit. It is necessary, in such units for the two ends of the arc discharge path provided by the fluorescent tube to be terminated adjacent to one another in a mounting containing the starter circuit, and therefore the arc discharge path of the fluorescent tube must be folded in an appropriate manner. In a so-called "twin-tube" arrangement, the fluorescent lamp comprises a U-shaped tube, the respective ends of the U being provided with the lamp filaments and being physically and electrically connected to the mounting.

In another arrangement, illustrated in FIG. 1, a so-called double twin-tube fluorescent lamp comprises two adjacent U-shaped tubes connected together to form an assembly 10, of which only one of the two tubes is visible in the drawing, a jointing connection 12, or so-called "kiss" joint providing a communication between the two tubes so that a single folded arc discharge path is arranged to extend through the two U-shaped tubes, via the joint 12. Each of the U-shaped tubes is provided with a corresponding filament at each end of the arc discharge path, only one such filament 14 being illustrated in the drawing. The filament 14 has coupled therefrom lead wires 16 and 18.

The double twin-tube bulb 10 is supported in a two-part base that is comprised of a base shell 20 and base bottom 22. The double twin-tube bulb 10 is secured in the base shell 20 by means of an appropriate cement such as is illustrated at 24 in FIG. 1.

FIG. 1 also illustrates pins 26 and 28 that are supported from the base bottom. A glow bottle starter switch 30 and capacitor 32 comprising the starter circuit are contained within the base bottom 22. Clamps 34 and 36 are employed, for example, to tie together lead wires for electrical connection between the various components, and in particular for connection between the glow bottle 30, capacitor 32, and lamp filaments. One of the lead wires 18 from the filament 14 couples to the clamp 36. A lead wire covered by insulator sleeve 38 also couples from the other filament to the clamp 34. Insulator sleeves 38 and 40 are used to prevent electrical shorting of leads. As indicated previously, the lamp starter components are encapsulated in the two-part base with the two lead wires from the respective lamp filaments being inserted into the pins 26 and 28 and staked to complete the assembly.

Thus, the assembly of FIG. 1 forms a fluorescent lamp unit of which the base bottom 22 and the pins 26 and 28 are adapted to form a plug connection capable of being physically and electrically connected to a base fitting (not shown) of the kind referred to above, that incorporates an associated ballast and has the fitting required for insertion into an electrical socket intended to receive a conventional incandescent lamp.

In the arrangement illustrated in FIG. 1, the double twin-tube assembly must be constructed by joining the two glass U-tubes to form the "kiss" joint 12. To make this joint each glass U-tube is heated locally and then pressurised with, for example, compressed air. The tubes rupture outwards simultaneously and because they are brought close together the expelled molten glass fuses, thus joining the two tubes. The glass joint is then annealed and the whole glass envelope evacuated on a specially designed exhaust machine.

This prior arrangement has a number of disadvantages, in particular that the joint 12 between the two U-tubes is a weak spot in the lamp construction, that the process of forming and subsequently annealing the joint is slow and requires complex machinery, and that separate stocks of U-tube components must be maintained to enable the manufacture of both the single and double twin tube fluorescent lamps.

It is an object of the present invention to overcome, or at least reduce, at least some of the disadvantages of the prior art.

The invention accordingly provides a fluorescent lamp unit which is characterised in that said fluorescent tube assembly comprises a plurality of folded fluorescent tubes each defining a separate arc discharge path between filaments located at respective ends of the tube, and that the separate arc discharge paths defined by said tubes are electrically connected in series between the electrical connections of the mounting.

Further, preferred features of the invention and corresponding advantages will become apparent from the subordinate Claims, in conjunction with the following description and the accompanying drawings.

The invention is illustrated by way of example in the accompanying drawings in which.

Figure 1:
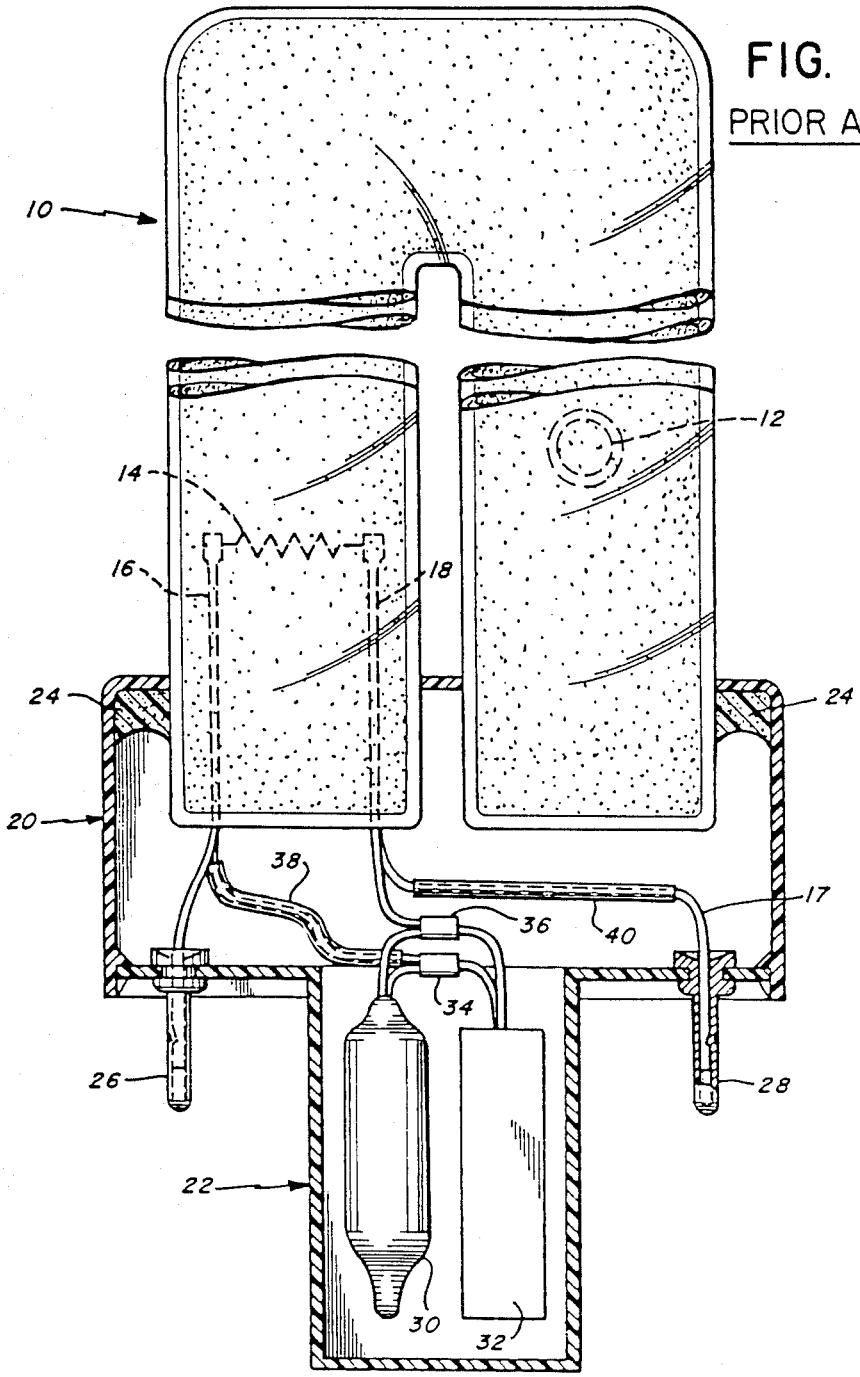
FIG. 1 PRIOR ART
FIG. 1 is an elevation, partly in section, of a known fluorescent lamp unit.
Figure 2:
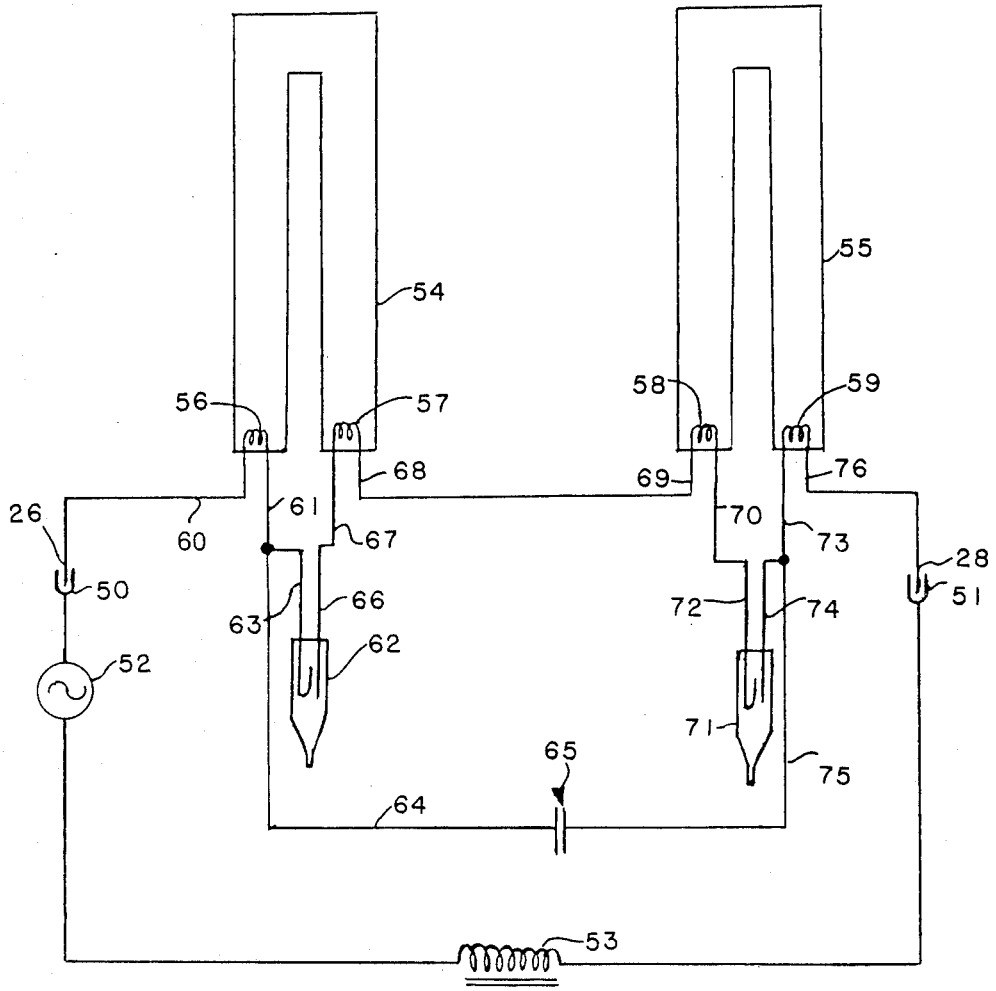
FIG. 2 is a diagram illustrating one example of a fluorescent lamp unit in accordance with the present invention, together with its associated operating circuit.

Referring to FIG. 2, the reference numerals 26 and 28 indicate diagramatically connecting pins equivalent to those having the same reference numerals and shown in FIG. 1. The reference numerals 50 and 51 indicate the corresponding electrical sockets of a base fitting with which the fluorescent lamp unit of the invention is to be used, and thus it will be appreciated that the portion of the circuit extending between sockets 50 and 51 forms part of the base fitting rather than the fluorescent lamp unit of the invention. In known manner the base fitting provides connections to the AC mains supply indicated diagrammatically at 52, and incorporates a ballast 53 as needed for the operation of the fluorescent lamp unit. The fluorescent lamp unit comprises two separate U-shaped fluorescent tubes, 54 and 55, each of which is of a construction as utilised in a known twin-tube fluorescent lamp unit in which only a single U-shaped tube is associated with a corresponding mounting containing the starter circuit. Thus, the tube 54 contains two filaments 56 and 57 at the respective ends of the tube, and the tube 55 likewise contains filaments 58 and 59.

The pin 26 is connected to the filament 56 via one lead in wire 60, the other lead in wire 61 of filament 56 being connected on the one hand to the bimetal terminal of a glow starter switch 62, by way of lead 63, and on the other hand, via lead 64, to one side of a capacitor 65. The post terminal of the glow starter switch 62 is connected via a lead 66 to a lead in wire 67 of the second filament 57 of tube 54, whereas the other lead in wire 68 of filament 57 is connected to a lead in wire 69 of the filament 58 of the second tube 55. The other lead in wire 70 from filament 58 is connected to the bimetal terminal of a second glow starter switch 71, via a connecting lead 72. The remaining filament 59 of tube 55 is connected via lead in wire 73 on the one hand to the post terminal of glow starter switch 71, via a connecting lead 74, and on the other hand, via a connecting lead 75, to a second terminal of the capacitor 65. The second lead in wire 76 of filament 59 is connected directly to the pin 28.

Thus it will be seen that in operation of the fluorescent lamp unit of FIG. 2, the path for the flow of electric current between pins 26 and 28 includes the two separate arc discharge paths of the U-tubes 54 and 55 that are effectively connected in series by lead in wires 60, 68, 69 and 76 coupled to the respective filaments of the two tubes. Each tube is provided with a separate glow bottle starter switch 62, 71 connected thereto via lead in wires 61, 67 and 70, 73 respectively. The starter circuit incorporating such glow bottles is completed by the single capacitor 65, although it would in principle be possible to replace this single capacitor by two separate capacitors each connected in parallel with the corresponding glow bottle switch 62 or 71.

By means of this circuit arrangement, it is possible to construct a lamp unit incorporating the two physically separate but electrically interconnected U-tubes 54 and 55 in replacement for the double twin-tube assembly 10 of FIG. 1, whilst maintaining a light output that is comparable with that of the unit 10. The disadvantages involved as a result of the requirement for the kiss joint 12 of the unit 10, are therefore eliminated.

It will, however, be noted that the electrical circuit of FIG. 2 involves, in comparison with that of the unit of FIG. 1, a considerably greater number of electrical connections. Bearing in mind the limited space available within the mounting 20, 22 of FIG. 1, considerable problems might be assumed to arise in the incorporation of the circuit of FIG. 2 within the same available space. Thus, in place of the four lead in wires to the two filaments of the unit 10 and the six electrical connections to be made to the pins 26, 28 the glow bottle 30, and the capacitor 32, the circuit of FIG. 2 involves eight lead in wires to the four tube filaments and additional electrical connections to a second glow starter switch, whilst at the same time the presence of the latter substantially reduces the available space within the mounting.

Figure 3:
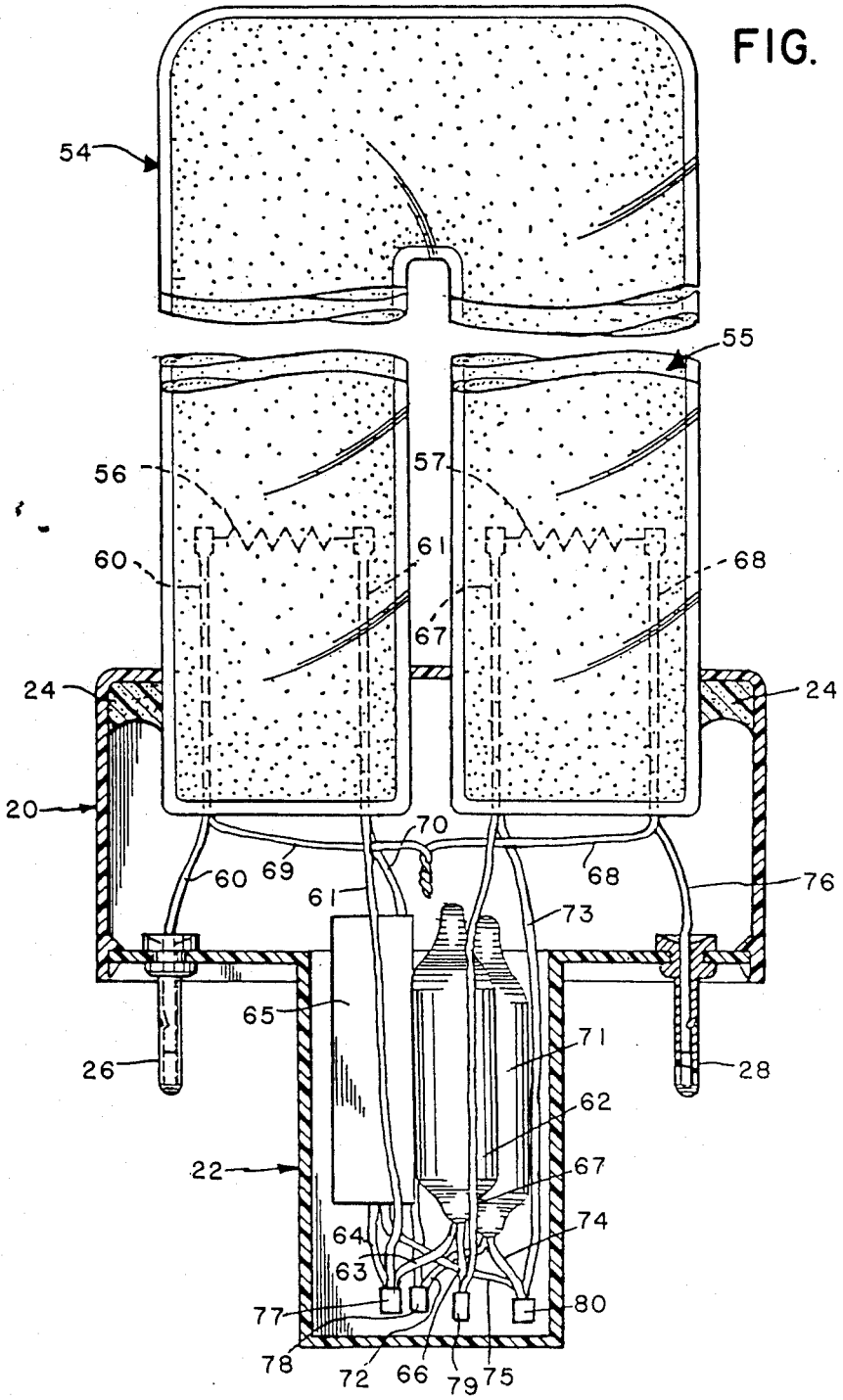
FIG. 3 is an elevation, partly in section, illustrating the constructional details of the fluorescent lamp unit shown in FIG. 2.

Referring now to FIG. 3, however, it will be seen that the potential problem referred to is overcome utilising an appropriate arrangement of the components and the interconnected wiring. In FIG. 3, the respective components and connecting leads are identified by the same reference numerals as in FIGS. 1 and 2.

It will be noted that in FIG. 3 the two U-tubes 54 and 55 are located directly behind one another, and that the four lead in wires of each tube are located in a common plane determined by the positions of the corresponding pinch seals at the respective ends of the tube, such seals not being illustrated in the drawing for simplicity. Thus, the two sets of lead in wires 60, 61, 67, 68 and 69, 70, 73, 76 lie in spaced parallel planes. The lead in wires 60 and 76 are led directly to the pins 26 and 28 which are located diagonally opposite one another in the shell 20 which is of generally rectangular configuration when considered in a plane extending transversely and perpendicular to the plane of the drawing. The two lead in wires 68 and 69 are directly connected together to lie diagonally across the housing 20 passing with ample clearance between the remaining four lead in wires 61, 67 and 70, 73. These latter four wires are lead directly and axially downwards into the recess provided by the base part 22. The capacitor 65 and glow bottles 62, 71, are located in such a manner as to maintain the adjacent lead in wires in spaced relation, and, are inverted relatively to the positions of the corresponding components of FIG. 1 so that all of the electrical connections can be made at points remote from the ends of the fluorescent tubes 54 and 55, the relevant connections being made by corresponding clamps 77, 78, 79 and 80.

As in the case of the arrangement described above with reference to FIG. 1, the electrical components are housed between the base shell 20 and the base bottom 22. However, unlike the known example illustrated in FIG. 1, the arrangement of the electrical leads in the embodiment of FIG. 3 is such that no electrically insulating sleeves are required upon the connecting wires, since the arrangement of the wiring is such that an appropriate spacing of all of the wires is reliably maintained.

Whilst a particular example of the invention has been illustrated and described above, it will be appreciated that various alterations may be made thereto without department from the scope of the invention as defined in the appended Claims. For example, although two identical U-shaped fluorescent tubes have been utilised in the arrangement illustrated, it would be possible to incorporate an assembly of fluorescent tubes of unequal length. Also, the respective fluorescent tubes may include phosphor layers providing different lamp colours. Furthermore, although the fluorescent lamp unit has been illustrated as incorporated in a particular type of lamp base, the configuration of the lamp base may be varied as desired.

We claim:

1. A fluorescent lamp unit comprising a fluorescent tube assembly (54, 55) defining a folded arc discharge path extending between filaments (56, 59) located at respective ends of said path, a mountng (20, 22), supporting said fluorescent tube assembly and providing releasable mechancial (22) and electrical (26, 28) connections for engagement with a base fitting, and starter means (62, 65, 71) housed within said mounting (20, 22) and electrically connected with said lamp filaments, characterised in that said fluorescent tube assembly comprises a plurality of folded fluorescent tubes (54, 55) each defining a separate arc discharge path between filaments (56, 57; 58, 59) located at respective ends of the tube, the separate arc discharge paths defined by said tubes are electrically connected in series between the electrical connections (26, 28) of said mounting (20, 22), each said fluorescent tube has lead in wires (60, 61, 67, 68; 69, 70, 72, 76) for the filaments (56, 57; 58, 59) at respective ends thereof disposed in an array of four wires extending from the tube substantially in a common plane, that the two tubes are mounted in juxtaposition with the said arrays of lead in wires located in opposite parallel planes, the four intermediate lead in wires (61, 67, 70, 73) are extended axially and connected to lead in wires of said starter means (62, 65, 71) at points remote from the ends of said fluorescent tubes, the casings of components forming said starter means (62, 65, 71) being located between said axially extending intermediate lead in wires (61, 67, 70, 73) to maintain the latter in spaced apart relation.

2. A fluorescent lamp unit according to claim 1 characterised in that said starter means comprises a separate glow starter switch (62, 71) for each fluorescent tube with the glow starter switches coupled in series and a single capacitor (65) connected across said series-coupled glow starter switches.

3. A fluorescent lamp unit according to claim 1 or 2, characterised in that said fluorescent tube assembly comprises two U-shaped fluorescent tubes (54, 55).

4. A fluorescent lamp unit according to claim 3, characterised in that said array of four wires extending from the tube is substantially in a common plane parallel to the plane of the U, that two outermost diagonally opposite lead in wires (60, 76) are arranged to extend into engagement with correspondingly positioned connecting pins (26, 28) of said mounting (20, 22) that the remaining two outermost diagonally opposite lead in wires (68, 69) are coupled together to extend diagonally between the four intermediate lead in wires (61, 67, 70, 73).

5. A fluorescent lamp unit according to claim 1, characterised in that said mounting (20, 22) comprises an upper housing part (20), receiving and physically supporting said fluorescent tubes (54, 55) and a lower housing part (22) supporting said connecting pins (26, 28) and providing a hollow central boss receiving said starter means (62, 65, 71) and the associated lead in wires (61, 67, 70, 73), said housing parts being assembled together to contain between them said lead in wires (61, 67, 70, 73) and the associated electrical components.

* * * * *